US006619541B2

(12) United States Patent
Martin et al.

(10) Patent No.: US 6,619,541 B2
(45) Date of Patent: Sep. 16, 2003

(54) MAILBOX ADVERTISING BONNET

(76) Inventors: Mike Martin, 2258 McEachern School Rd., Powder Springs, GA (US) 30127; Juanita Martin, 2258 McEachern School Rd., Powder Springs, GA (US) 30127

( * ) Notice: Subject to any disclaimer, the term of this patent is extended or adjusted under 35 U.S.C. 154(b) by 0 days.

(21) Appl. No.: 09/963,758

(22) Filed: Sep. 26, 2001

(65) Prior Publication Data

US 2003/0057267 A1 Mar. 27, 2003

(51) Int. Cl.[7] ..... B65D 91/00
(52) U.S. Cl. ..... 232/38
(58) Field of Search ..... 232/38; 40/539, 40/124.09, 124.19, 623, 620; 52/3, 5

(56) References Cited

U.S. PATENT DOCUMENTS 1,708,019 A * 4/1929 Krotoschin ..... 40/124.09
2,631,046 A * 3/1953 Stephens ..... 283/56
3,445,949 A * 5/1969 Rohde ..... 40/124.19
3,749,903 A * 7/1973 Belokin, Jr. ..... 40/431
4,813,595 A 3/1989 Johns, Jr. et al.
D312,912 S 12/1990 Klahre
4,991,769 A 2/1991 Todd
5,035,356 A 7/1991 Granger
D322,418 S 12/1991 White
5,072,979 A * 12/1991 Swinton ..... 293/128
D385,676 S 10/1997 Childress et al.
5,778,574 A * 7/1998 Reuben ..... 40/124.03
6,018,898 A * 2/2000 Auty et al. ..... 40/5
6,296,180 B1 * 10/2001 Blizzard ..... 232/38
6,308,884 B1 * 10/2001 Hamburger ..... 232/38

* cited by examiner

*Primary Examiner*—William L. Miller
(74) *Attorney, Agent, or Firm*—Myers & Kaplan, LLC; Joel D. Myers, Esq.; Barry E. Kaplan, Esq.

(57) ABSTRACT

A mailbox advertisement bonnet, wherein a durable, waterproof advertising board carrying a printed public notice thereon is provided, and wherein the mailbox advertisement bonnet is dimensioned to fit over and be secured to a conventional mailbox.

1 Claim, 3 Drawing Sheets

MAILBOX ADVERTISING BONNET

TECHNICAL FIELD

The present invention relates generally to mailbox advertisements, and more specifically to a mailbox advertisement bonnet.

BACKGROUND OF THE INVENTION

Public advertising of auspicious or significant occasions has become common practice in today's society. From celebrating a birthday or anniversary to announcing the birth of a baby or a student graduation, celebrators of any such occasion typically go to great lengths to publicize the celebrated event and/or occurrence.

In addition to publicly announcing special events via advertisements, some individuals simply display personal advertisements year-round, such as country and state flags to demonstrate patriotism, pictures of school mascots and/or logos to convey school spirit and support, and/or religious symbols to declare one's religious convictions.

Furthermore, holidays and holiday celebrations naturally result in extravagant decorations to parade holiday spirit. For example, the Christmas Holidays typically bring pictorial depictions of Santa Clause and mistletoe, wherein Halloween brings pictures of pumpkins and witches.

Although celebrating any special event is joyful, decorating for the celebration itself can often prove time-consuming and frustrating. For instance, posters and pictures can become difficult to maintain when displayed outside the home, especially during wet, cold rainy and/or snowy seasons. Moreover, large, weighty banners often sag, balloons eventually deflate, decals can peel or partially rub off, and paper-based decorations succumb to wet weather and/or natural wear-and-tear.

Therefore, it is readily apparent that there is a need for a mailbox advertisement bonnet, wherein a sturdy, waterproof advertisement dimensioned to fit over a conventional mailbox is provided.

BRIEF SUMMARY OF THE INVENTION

Briefly described, in a preferred embodiment, the present invention overcomes the above-mentioned disadvantages, and meets the recognized need for such a device by providing a mailbox advertisement bonnet, wherein a durable, waterproof advertising board carrying a printed public notice thereon is provided, and wherein the mailbox advertisement bonnet is dimensioned to fit over and be secured to a conventional mailbox.

According to its major aspects and broadly stated, the present invention in its preferred form is a mailbox advertising bonnet having a waterproof board carrying a design or picture thereon and a tie-string.

More specifically, the present invention is a mailbox advertising bonnet having a waterproof board having three parallel partial cuts that form folding axes to permit pliability and manipulation of mailbox advertisement bonnet over a conventional mailbox. Mailbox advertisement bonnet is secured to a conventional mailbox via a tie-string carried by a first throughhole and secured to a second throughhole, wherein first and second throughholes are formed on opposing ends of the waterproof board, and wherein the exterior surface of the waterproof board carries a desired printed public advertisement thereon.

A feature and advantage of the present invention is its ability to provide a durable, waterproof public advertisement.

A feature and advantage of the present invention is its ability to be secured to any conventional mailbox.

A feature and advantage of the present invention is its ability to permit the display of most any desired advertisement, personal notice, logo, emblem, symbol, message and/or note thereon.

A feature and advantage of the present invention is its ability to be quickly and easily installed.

A feature and advantage of the present invention is its ability to be easily removed from, transported to and reinstalled on another conventional mailbox.

A feature and advantage of the present invention is its ability to carry two different advertisements on opposing sides to enable changing from one advertisement to another.

A feature and advantage of the present invention is its ability to be stored away for future use.

A feature and advantage of the present invention is its ability to provide a portable and convenient advertisement.

A feature and advantage of the present invention is its ability to provide a waterproof pouch attached thereto for the insertion of different advertisements therein.

A feature and advantage of the present invention is its simplicity of disposability.

A feature and advantage of the present invention is its ability to provide an advertisement that can be painted over, or covered up via any other suitable masking means, for the placement thereon of a new advertisement.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

Figure 1:
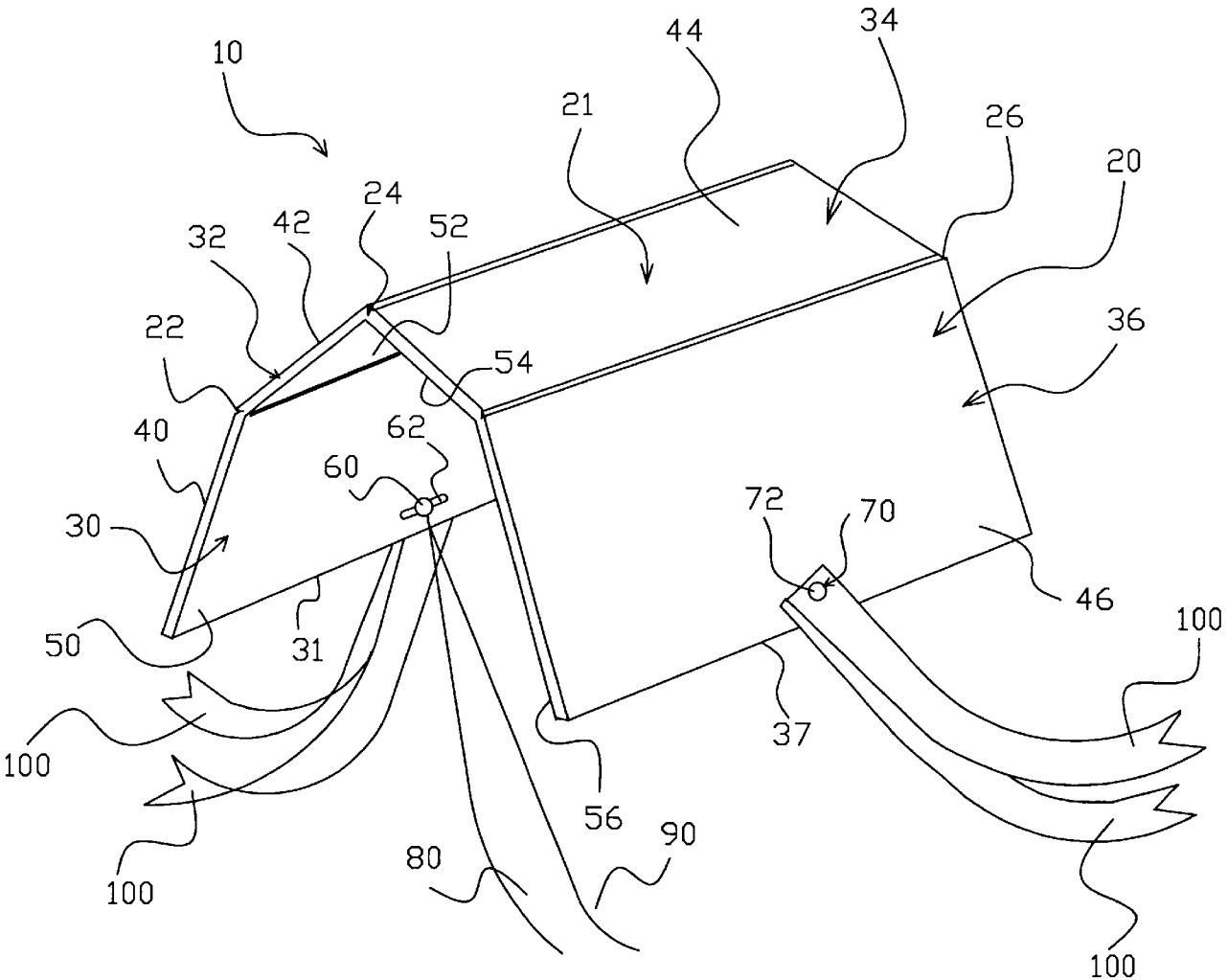
FIG. 1 is a front perspective view of a mailbox advertisement bonnet according to a preferred embodiment of the present invention.
Figure 2:
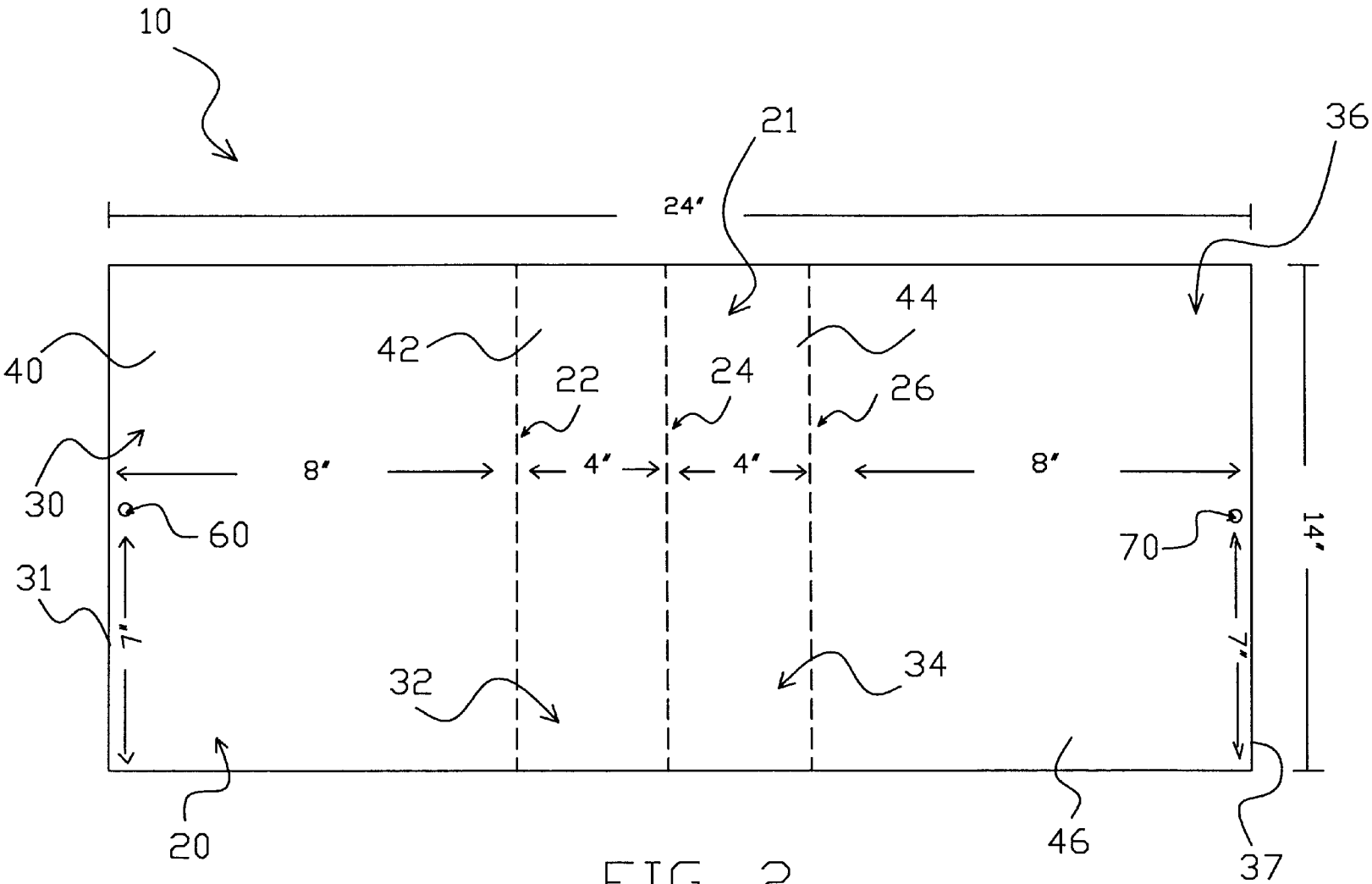
FIG. 2 is a diagram of a mailbox advertisement bonnet according to a preferred embodiment of the present invention, showing the preferred dimensions of the invention.
Figure 3:
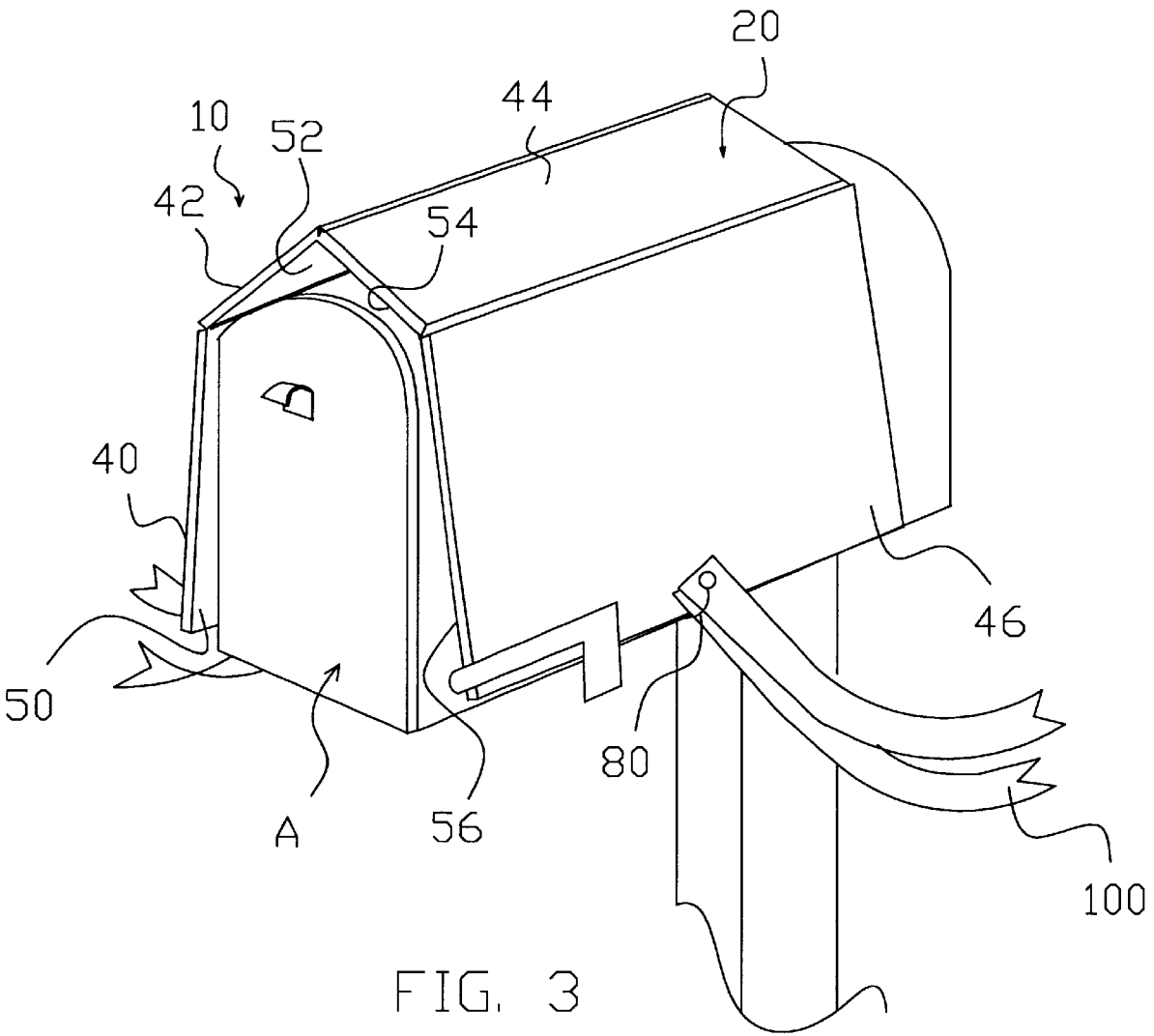
FIG. 3 is a front perspective view of a mailbox advertisement bonnet according to a preferred embodiment of the present invention, showing the invention in use.

In describing the preferred embodiments of the present invention, as illustrated in FIGS. 1–3, and alternate embodiments, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1–2, the present invention in its preferred embodiment is a device 10, wherein device 10 is a mailbox advertisement bonnet generally comprising a board 20, throughholes 60 and 70 and tie-strings 80 and 90.

Specifically, board 20 is preferably formed from a blank of corrugated, water-proof plastic material and is preferably substantially rectangular in shape. Board 20 further comprises preferably three parallel partial cuts 22, 24 and 26 or scores formed along the width of board 20 and on face 21 of board 20, wherein partial cuts 22, 24 and 26 foldably divide board 20 into preferably four sections 30, 32, 34 and 36. Sections 30 and 36 are preferably of equal size and are preferably larger in length than sections 32 and 34, wherein sections 32 and 34 are preferably of equal size as compared to one another. Sections 30, 32, 34 and 36 preferably comprise top surfaces 40, 42, 44 and 46, respectively, and bottom surface 50, 52, 54 and 56, respectively. Partial cuts 22, 24 and 26 preferably enable board 20 to be foldably manipulated to fit over or cover a conventional mailbox.

Centrally positioned proximal to edges 31 and 37 of sections 30 and 36, respectively, are throughholes 60 and 70, respectively, wherein tie strings 80 and 90 extend through throughhole 60 to enable the secured tying of board 20 to a conventional mailbox via the extension and tying-off of strings 80 and 90 through throughhole 70. Throughholes 60 and 70 further preferably receive ribbons 100 secured therethrough via preferably fasteners 62 and 72, respectively, wherein fasteners 62 and 72 have preferably bendable tabs. In alternate embodiments, fasteners 62 and 72 can be any fastening means such as, for exemplary purposes, rivets, clasps or pronged fasteners or can be integrally formed thereto.

Top surfaces 40, 42, 44 and 46 preferably display advertisements thereon, wherein the advertisements may be printed, painted or adhered thereon and can be any desired advertisement, such as, for exemplary purposes only, a personal notice, logo, emblem, symbol, message or celebratory slogan or picture.

Referring specifically now to FIG. 2, board 20 is preferably of sufficient size and dimension to cover and be maintained over any conventional mailbox. Particularly, board 20 is preferably twenty-four inches in length by fourteen inches in width, wherein partial cuts 22, 24 and 26 preferably divide board 20 such that sections 30 and 36 are preferably eight inches in length by fourteen inches in width, and sections 32 and 34 are preferably four inches in length by fourteen inches in width.

As best depicted in FIG. 3, device 10 is presented over a conventional mailbox such that bottom surfaces 50, 52, 54 and 56 abut the surface of conventional mailbox A. Furthermore, top surfaces 40, 42, 44 and 46 preferably face outward and adorn any desired advertisement thereon.

In an alternate embodiment, bottom surfaces 50, 52, 54 and 56 could also possess advertisements displayed thereon to allow board 20 to be turned over and depict a different advertisement, wherein board 20 could possess further partial cuts to allow folding and manipulation of board 20 over a conventional mailbox.

In another alternate embodiment, board 20 could be dimensioned to cover non-conventional mailboxes of varied size and shape.

In another alternate embodiment, throughholes 60 and 70 could carry multiple tie-strings for added securement of device 10 to a conventional mailbox.

In yet another alternate embodiment, board 20 could be dimensioned to partially or fully cover a conventional mailbox.

In still another alternate embodiment, board 20 could be formed from other waterproof material such as, for exemplary purposes only, water-sealed wood, metal or plastic-coated cardboard including non-corrugated material.

In still another alternate embodiment, board 20 could be made to fold via the incorporation of different folding mechanisms, such as for exemplary purposes only, hinges or adjoining straps 110.

In still another alternate embodiment, device 10 could be secured to a conventional mailbox via other securing means such as, for exemplary purposes only, buckle-and-strap mechanisms, hook-and-loop fasteners or adhesives.

In another alternate embodiment, board 20 could define any shape, such as, for exemplary purposes only, square, oval or diamond shaped.

In another alternate embodiment, any number or combination of surfaces 40, 42, 44, 46, 50, 52, 54 and 56 could have an advertisement thereon.

In yet another alternate embodiment, board 20 could possess a waterproof pouch attached thereto for the carrying and/or exchanging of multiple advertisements.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A method of advertising, comprising the steps of:

a. obtaining a blank of material;

b. scoring three spaced lines to form four sections in said blank of material;

c. folding said blank of material via said score lines;

d. placing folded said blank of material over a conventional mailbox; and securing said blank of material to the mailbox via a securing means.

* * * * *